US005246265A

United States Patent [19]

Nagan et al.

[11] Patent Number: 5,246,265

[45] Date of Patent: Sep. 21, 1993

[54] LOUNGE CHAIR

[76] Inventors: Karen A. Nagan; Brian J. Nagan, both of 205 W. Peckham St., Neenah, Wis. 54956

[21] Appl. No.: 946,594

[22] Filed: Sep. 18, 1992

[51] Int. Cl.[5] ..... A47C 4/00

[52] U.S. Cl. ..... 297/54; 297/31; 297/344.18

[58] Field of Search ..... 297/19, 29, 31, 34, 297/35, 45, 51, 52, 53, 54, 218, 223, 229, 441, 345

[56] References Cited

U.S. PATENT DOCUMENTS

| | | | |
|---|---|---|---|
| 2,783,823 | 3/1957 | Tony | 297/54 |
| 4,141,585 | 2/1979 | Blackman . | |
| 4,508,384 | 4/1985 | Castelot et al. . | |
| 4,892,353 | 1/1990 | Goddard . | |
| 4,921,301 | 5/1990 | Hannes . | |
| 4,948,197 | 8/1990 | Sansing | 297/345 X |
| 4,979,375 | 12/1990 | Nathans et al. . | |
| 5,061,011 | 10/1991 | Miller . | |

FOREIGN PATENT DOCUMENTS

| | | | |
|---|---|---|---|
| 718700 | 9/1965 | Canada | 297/31 |
| 2237972 | 2/1974 | Fed. Rep. of Germany | 297/53 |
| 644558 | 10/1950 | United Kingdom | 297/54 |

*Primary Examiner*—Laurie K. Cranmer
*Attorney, Agent, or Firm*—Richard C. Litman

[57] ABSTRACT

A lounger which comprises a frame and a cover. The frame includes a seat section, a back rest section, and a foot rest section. The seat section is supported by two legs. Positioning gears are provided which permit the legs as well as the back rest and the foot rest section to be folded. Each of the legs are engagable in a locking position and the back rest and the foot rest section are engagable in a plurality of locking positions. The legs may be telescopic to permit the elevation of the lounger to be varied. Laterally disposed cross members improve the structural integrity of the telescopic legs. The cover is stretchable about the frame and may be removable. The cover is fabricated of a mixture of nylon yarn and spandex fibers, providing a breathable and moisture absorbent cover which is cool and comfortable to the user. A supplemental support may be provided to ensure that the lounger is capable of sustaining a large robust person. Moreover, the frame and the cover can be dimensioned and configured so as to support a large, robust person.

16 Claims, 2 Drawing Sheets

LOUNGE CHAIR

BACKGROUND OF THE INVENTION

1. Field of the Invention

The present invention relates to portable folding furniture and, more particularly, to a portable folding lounger having a strong elastic breathable fitted fabric conver and being structured to comfortably support a tall and robust person.

2. Description of the Prior Art

A seat or chair structure that supports some type of pad or covering has been appreciated in prior art. Such a pad or covering is often of a canvas or a synthetic material which may become soiled and after exposure to the sun may fade or become hot. A prior art lounger having a canvas covering is described, for example, in U.S. Pat. No. 4,921,301 issued May 1, 1990 to R. Jalaine Haynes. Another lounger having a canvas or plastic covering is shown in U.S. Pat. No. 4,892,353 issued Jan. 9, 1990 to Dan J. Goddard.

Methods of enhancing the comfort of a longer are known. It is common practice to drape a towel or blanket over the chair for comfort and convenience of the user. The towel or blanket absorbs tanning oils and lotions and protects the user from the hot surface of the covering. The disadvantage of the towel or blanket is that the towel or blanket is subject to shifting. Accordingly, the user must continually readjust or reposition the same to make certain that it covers the surface beneath the user. A mat would be an alternative to a towel or blanket. For instance, U.S. Pat. No. 4,979,735 issued Dec. 25, 1990 to Robert L. Nathans et al. discloses a mat positioned upon a lounge chair. The mat is comprised of a plurality of parallel channels being fabricated of a flexible vinyl plastic. A continuous flow of water is circulated through each channel to facilitate cooling a person using the lounge chair.

Another lounger which provides a cooling effect is described in U.S. Pat. No. 4,141,585 issued Feb. 27, 1979 to Wynona Blackman. Blackman teaches a folding cooling lounge chair having a plurality of vented chambers, each adapted to receive a coolant therein. A fan is employed to create air flow through the chambers, forcing air through the vents to cool a person off.

A variety of lounge chairs have been described and various methods have been devised to keep the user of lounge chairs cool, however, a lounge chair which is covered with a fabric having a composition with a low coefficient of absorption would absorb less radiant heat when exposed to the sunlight and, in turn, remain cooler and provide greater comfort for the user. Moreover, a woven fabric having a large number infinitesimal interstices would be exceptionally breathable and moisture absorbent and thus, provide a cooler, more comfortable lounge chair.

Prior art shows that lounge chair structures have also gone through a metamorphic change evolving into the present day conventional lounge chair. Structures of this type are generally illustrated, for example, in U.S. Pat. No. 4,508,384 issued Apr. 2, 1985 to Lawrence E. Castelot et al. Castelot illustrates a footrest frame and a backrest frame, each of which are foldable to a posture adjacent the top surface of a seat frame. Similarly, the legs are foldable to a position adjacent the bottom surface of the seat frame, thus providing a chair that is foldable into a small compass. An alternative frame structure is shown in U.S. Pat. No. 5,061,011 issued Oct. 29, 1991 to Robert H. Miller. Miller discloses a chaise lounger having a seat, a back, and a lounge member which is removably connectable to the seat such that it extends forward of the seat. Stabilizing bars connected between the front legs and the lounge member provide supplemental support. One issue identified with seat and chair structures which has yet to be addressed is the discomfort associated with being seated in the same. A disadvantage of conventional chairs is that the frame is typically low to the ground. The present inventor has found that a need exists for a chair which may vary in height, a chair which may be in the form of a lounger in which all of the components are contained therein and which may be readily folded for storage and transportation.

None of the above patents, taken either singly or in combination, is seen to describe the instant invention as claimed.

SUMMARY OF THE INVENTION

The present invention relates to a lounger which comprises a frame and a cover. The frame includes a seat section having a pair of tubular side members spaced apart and disposed parallel to each other. Each of the tubular side members have opposite ends engagable with respective positioning gears located to the front and the rear of the tubular side members. The front and rear tubular, telescopic legs are both substantially U-shaped. Each of the legs are laterally disposed. Each of the legs further has opposite ends engagable with the respective positioning gears. Laterally disposed cross members improve the structural integrity of each telescopic leg. Each leg is foldable toward the other leg and toward the seat section as well as foldable away from one another and away from the seat section to a point where the legs are engagable in a locked position. A back rest section and a foot rest section are each comprised of laterally disposed substantially U-shaped tubular members. These tubular members each have opposite ends, each end being fastened to a respective positioning gear. The foot rest section and the back rest section are foldable toward each other and the seat section as well as foldable away from each other and away from the seat section. Both the foot rest and back rest section are each engagable in a plurality of locking positions throughout their pivotal movement. The cover is unitary as well as stretchable about the frame and may be removable. The cover is fabricated of a fabric being eighty-six percent nylon yarn, preferably Supplex brand nylon manufactured by E. I. Du Pont De Nemours and Company of the United States, and fourteen percent, preferably Lycra brand spandex also manufactured by E. I. Du Pont De Nemours and Company. This particular fabric composition is breathable and moisture absorbent, providing a cool comfortable lounger. The frame and the cover should be dimensioned and configured to support a large, robust person. A supplemental support, such as webbed nylon straps, may be provided to ensure that the lounger is capable of supporting a large robust person.

Accordingly, it is a principal object of the invention to provide a lounger which comprises a frame having a frame which includes a plurality of sections, that is, a seat, a foot rest, and a back rest section, each section being fabricated of tubular members.

It is another object of the invention to provide a lounger having positioning gears for releasably locking both the back rest and foot rest sections in a variety of positions.

It is a further object of the invention to provide a lounger having front and rear telescopic U-shaped tubular legs, being laterally disposed and having opposite ends engagable with respective positioning gears.

It is another object of the invention to provide a lounger having laterally disposed cross members to improve the structural integrity of the telescopic legs.

It is a yet another object of the invention to provide a lounger having legs foldable toward the other leg and toward the seat section as well as foldable away from one another and away from the seat section to a point where the legs are engagable in a locked position.

Another object of the invention is to provide a lounger having a back rest and foot rest section which are each fastened to a respective positioning gear to enable both the foot rest and back rest sections to be foldable toward each other and toward the seat section as well as away from each other and away from the seat section.

Still another object of the invention is to provide a lounger having foot and back sections each of which are engagable in a plurality of locking positions throughout their pivotal movement.

A further object of the invention is to provide a lounger having a cover which is unitary as well as stretchable about the frame and which may be removable.

Still another object of the invention is to provide a lounger having a cover which is fabricated of a fabric being eighty-six percent nylon yarn and fourteen percent spandex, thus providing a cover which is breathable and moisture absorbent, providing a cool comfortable lounger.

Another object of the invention is to provide a lounger having a frame and cover dimensioned and configured to support a large, robust person.

Further, an object of the invention is to provide a lounger having supplemental supports to ensure that the lounger is capable of supporting a large robust person.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
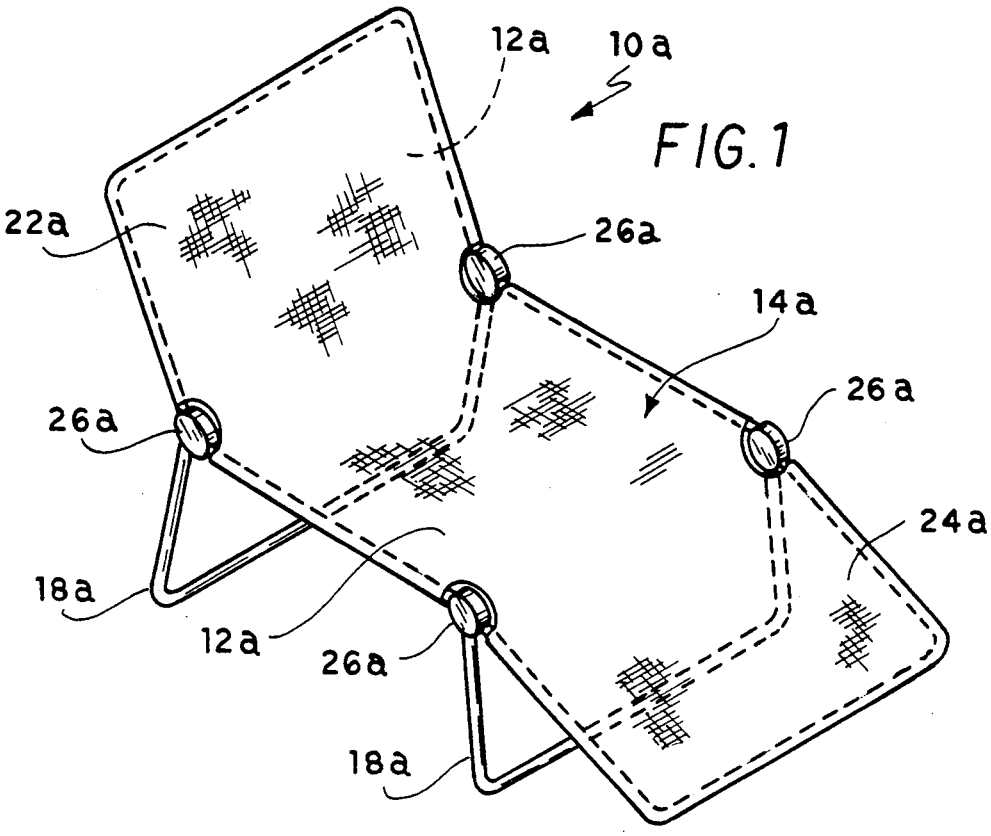
FIG. 1 is a perspective view of the present invention.

The present invention a lounger 10*a*. The lounger 10*a*, as shown in FIG. 1, is comprised of a frame 12*a* and a fabric cover 14*a*. The frame 12*a* includes a seat section 16*a* supported by front and rear U-shaped legs 18*a*. A back rest 22*a* and a foot rest 24*a* are pivotally attached to a rear and front portion of the seat section 16*a*, respectively. The front leg 18*a* and the foot rest 24*a* are each independently engagable with left and right front positioning gears 26*a* located proximate the front portion of the seat section 16*a*. The rear leg 18*a* and the back rest 22*a* are each independently engagable with left and right rear positioning gears 26*a* located proximate the rear portion of the seat section 16*a*. The positioning gears 26*a* are of the conventional type currently known in the prior art. The frame 12*a* is fabricated of a strong, durable light weight material, preferably a tubular metal, such as aluminum tubing. Unlike conventional loungers, the present invention should be dimensioned and configured to accommodate a large and/or robust person. The overall dimensions of the present inventions should preferably be six feet four inches in length, three feet in width, and at least one and one half feet high. The preferred length of the frame 12*a* can be achieved with a foot rest section 24*a* and a head rest section 22*a* each being two feet in length and a seat section 16*a* being two feet four inches in length. The fabric cover 14*a* is a mixture of nylon yarn and spandex fiber. The nylon yarn is preferably Supplex brand nylon manufactured by E. I. Du Pont De Nemours and Company of the United States and the spandex fiber is preferably Lycra brand spandex also manufactured by E. I. Du Pont De Nemours and Company. A mixture of eighty-six percent of nylon yarn and fourteen percent of spandex fiber provides a strong support which is both breathable and moisture absorbent. This fabric composition provides a cool comfortable fabric cover 14*a*. When a predetermined weight or thickness of the fabric is employed, the fabric cover 14*a* can support a large or robust user (not shown).

The unitary fabric cover 14*a* is designed to stretch tightly over the frame such that fabric cover 14*a* covers all three sections of lounger 10*a*, i.e., the back rest 22*a*, the seat section 16*a* and the foot rest 24*a*.

Figure 2:
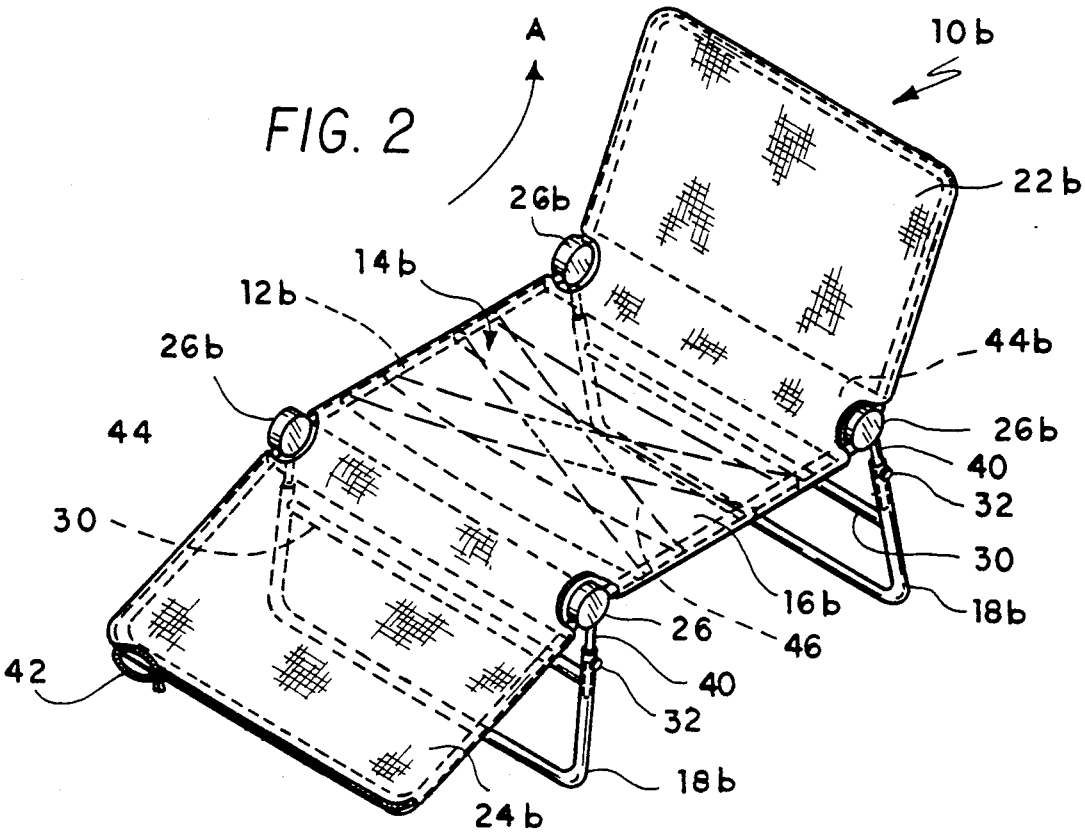
FIG. 2 is a perspective view of an alternative embodiment of the present invention.

FIG. 2 is an alternative embodiment of the lounger 10*b*. The frame 12*b* of this alternative embodiment is similar to the aforementioned frame 14*a*. However, this frame 12*b* incorporates front and rear legs 18*b* which telescopically or slidably engagable with the positioning gears 26*b* to provide a means to vary the elevation of the frame 12*b* to a height of up to one and one half feet or more. Additionally, laterally disposed cross-members 30 are integral with each of the legs 18*b* to enhance the structural integrity of the legs 18*b* and, in turn, of the frame 10*b*.

Figure 3:
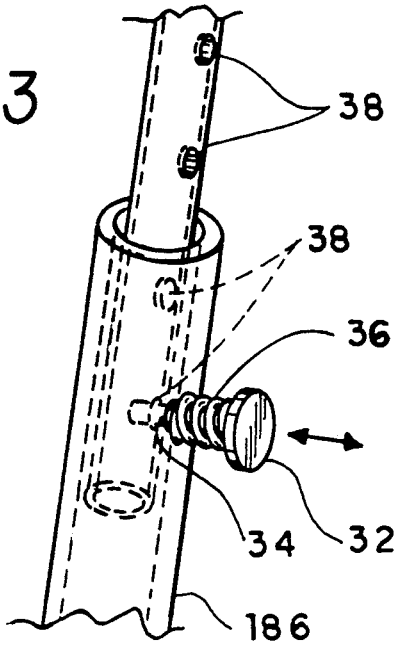
FIG. 3 is a detail of the telescopic leg of the lounger.

FIG. 3 shows one method of engaging and disengaging the legs 18*b*. The particular assembly utilizes a pin 32 attached to each end of each leg 18*b*. The pins 32 are each normally biased inward into and through an aperture 34. This is accomplished through the use of a spring 36 carried by the pin 32. A plurality of holes 38 are provided in an elongated member 40 which extends from each of the positioning gears 26*b*. The elevation of the frame 10*b* is adjusted simply by independently withdrawing the pin 32 from the leg 18*b* clear of the holes 38 in the elongated member 40 and by slidably adjusting the elongated member 40 within the leg 18*b*, thus varying the hole 38 which aligns with the pin 32. Once the elongated member 40 has been adjusted to the desired length, the pin 32 may be releases to engage with the hole 38 nearest the pin 32. The legs 18*a* may be removed entirely, simply by withdrawing the pins 32 and holding the pins 32 in this withdrawn posture until the respective elongated members 40 are each slidably disengaged from the respective ends of the legs 18*a*.

Referring back to FIG. 2, the unitary fabric cover 14*b* may be removable. A fastener 42 is provided preferably at the forward end of the foot section 24*b* of the fabric cover 14*b*. The fabric cover 14*b* may be removed by unfastening the fastener 42 and by removing the legs 18*a* in the above prescribed manner. Having accomplished this, the fabric cover 14*b* may be slipped off the frame 12*b* in the direction A. This enables the fabric cover 14*b* to be machined washed. Alternatively, the fastener 42 may be eliminated if at least one lateral opening 44 is provided either between the seat section 16*b* and the back rest section 22*b* or between the seat section 16*b* and the foot rest section 24*b*. This enables the frame 12*b* to ingress into and egress from the fabric cover 14*b* merely by manipulating the frame 14*b*.

Also shown in FIG. 2 is a supplemental support 46 which may be permanently or removably attached to the seat section 16*b*. The support 46 may be fabricated of the same material as the cover 14*b* or may be a webbed nylon strap, similar to that used for automobile safety belts. The fabric cover 14*b* may cover both the front and the back side of the frame 12*b*, concealing the support 46 therein. This support 46 ensures that the lounger 10*b* will sustain a large robust user.

Figure 4:
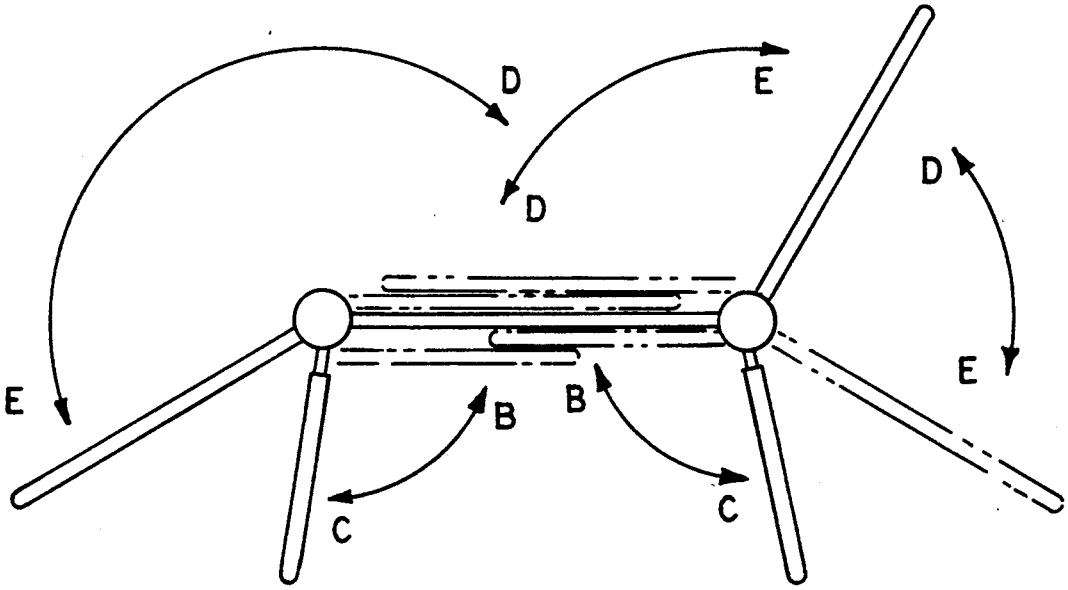
FIG. 4 is a diagrammatic view showing the mobility of the lounger frame.

FIG. 4 shows the directions in which the legs 18*a*,18*b* the back rest section 22*a*,22*b*, and the foot rest section 24*a*,24*b* may be manipulated or may move relative to the seat section 16*a*,16*b*. The legs 18*a*,18*b* are foldable toward each other and toward the seat section in the direction B. The legs 18*a*,18*b* are further pivotal away from each other in the direction C and are engagable in a locking position. The foot rest section and the back rest section are foldable toward each other and toward the seat section in the direction D, are further pivotal away from each other in the direction E, and are engagable in a plurality of locking positions through the movement in the direction D.

It is to be understood that the present invention is not limited to the embodiments described above, but encompasses any and all embodiments within the scope of the following claims.

We claim:

1. A lounger comprising:

a) a frame including:

1) a seat section;

2) a front leg pivotally joined to a forward portion of said seat section;

3) a rear leg pivotally joined to a rearward portion of said seat section;

said legs are foldable toward each other and toward said seat section, said legs further being engagable in a locking position; and 4) a back rest section pivotally joined to a rearward portion of said seat section;

5) a foot rest section pivotally joined to a forward portion of said seat section;

said both said foot rest section and said back rest section are foldable toward each other and toward said seat section and are engagable in a plurality of locking positions through a movement of the same; and b) a cover of unitary construction stretched tightly about said frame to cover said seat section, said back rest section and said foot rest section and secured about the periphery of said frame to support a user of said lounge, said cover being of a nylon yarn and a spandex fiber.

2. The lounger according to claim 1, wherein said front and rear legs are telescopically adjustable to produce a variance in elevation of said frame.

3. The lounger according to claim 2, wherein said front and rear legs each include a lateral cross member which provides enhanced structural integrity.

4. The lounger according to claim 1, wherein said seat section is provided with a supplemental support.

5. The lounger according to claim 4, wherein said supplemental support is a laterally disposed strip of resilient webbing.

6. The lounger according to claim 1, further includes means for removably securing said legs to said frame.

7. The lounger according to claim 6, further includes means for removably securing said cover to said frame.

8. A lounger comprising:

a) a frame including:

1) a seat section;

2) a front leg being pivotally joined to a forward portion of said seat section, said front leg being engagable in a locking position to support a front portion of said seat, said front leg further being telescopically adjustable to produce a variance in elevation of said seat;

3) a rear leg being pivotally joined to a rearward portion of said seat section, said rear leg being engagable in a locking position to support a rear portion of said seat, said rear leg further being telescopically adjustable to produce a variance in elevation of said seat;

said legs are foldable toward each other and toward said seat section;

4) a back rest section pivotally joined to a rearward portion of said seat section; and 5) a foot rest section pivotally joined to a forward portion of said seat section;

both said foot rest section and said back rest section are foldable toward each other and toward said seat section and are engagable in a plurality of locking positions through a movement of the same; and b) a removable cover of unitary construction stretched tightly about said frame to cover said seat section, said back rest section and said foot rest section and secured about the periphery of said frame to support a user of said lounge.

9. The lounger according to claim 8, wherein said front and rear legs each include a lateral cross member to provide supplemental support for said frame.

10. The lounger according to claim 8, wherein said seat section is provided with a supplemental support.

11. The lounger according to claim 10, wherein said supplemental support is a laterally disposed strip of resilient webbing.

12. The lounger according to claim 8, wherein said cover is made of a nylon yarn and a spandex fiber.

13. A lounger comprising:

a) a frame including:

1) a seat section having a pair of tubular side members spaced apart and disposed in a parallel manner, each of said tubular members having opposite ends and having a positioning gear fastened to each of said ends, thus providing a pair of said positioning gears located forward of said tubular side members and a pair of said positioning gears located rearward of said tubular side members;

2) a front telescopic leg comprising a frontal laterally disposed substantially U-shaped tubular member having opposite ends, each one of said ends of said front substantially U-shaped tubular member being telescopically engagable with a respective one of said pair of said positioning gears located forward of said tubular side members, said front telescopic leg further comprising a laterally disposed cross member to improve structural integrity of said front telescopic leg;

3) a rear telescopic leg comprising a rearward laterally disposed substantially U-shaped tubular member having opposite ends, each one of said ends of said rear substantially U-shaped tubular member being telescopically engagable with a respective one of said pair of said positioning gears located rearward of each of said tubular side members, said rear telescopic leg further comprising a laterally disposed cross member to improve structural integrity of said rear telescopic leg, wherein said legs are foldable toward each other and toward a bottom surface of said seat section and are foldable away from each other and away from said bottom surface of said seat section to a point slightly past a vertical displacement where said legs are engagable in a locking position, thus substantially limiting pivotal movement of said legs to an area beneath said seat section, said legs further being independently, telescopically adjustable to provide a variance in elevation of said lounger;

4) a back rest section comprising a back end laterally disposed substantially U-shaped tubular member having opposite ends, each one of said ends of said back end substantially U-shaped tubular member being fastened to a respective one of said pair of said positioning gears located rearward of said tubular side members; and 5) a foot rest section comprising a foot end laterally disposed substantially U-shaped tubular member having opposite ends, each one of said ends of said foot end substantially U-shaped tubular member being fastened to a respective one of said pair of said positioning gears located forward of each of said tubular side members, wherein said both said foot rest section and said back rest section are foldable toward each other and toward a top surface of said seat section and are foldable away from each other and away from said top surface of said seat section to a point slightly above a supporting surface, said foot rest section and said back rest section are each engagable in a plurality of locking positions through a movement of the same; and b) a cover stretched taut about said frame to support a user of said lounge, said cover being of a nylon yarn and a spandex fiber.

14. The lounger according to claim 13, wherein said seat is provided with a supplemental support.

15. The lounger according to claim 14, wherein said supplement support is a laterally disposed strip of resilient webbing.

16. The according to claim 13, further comprising means for removably securing said cover to said frame.

* * * * *